US005152663A

United States Patent [19]

Peroaho et al.

[11] Patent Number: 5,152,663

[45] Date of Patent: Oct. 6, 1992

[54] CENTRIFUGAL PUMP

[75] Inventors: Tapio Peroaho, Tavastila; Reijo Vesala, Kotka; Vesa Vikman, Kymi, all of Finland

[73] Assignee: A. Ahlstrom Corporation, Noormarkku, Finland

[21] Appl. No.: 579,404

[22] Filed: Sep. 7, 1990

[51] Int. Cl.[5] ..... F04D 13/12

[52] U.S. Cl. ..... 415/131; 415/169.1; 417/68

[58] Field of Search ..... 415/169.1, 143, 34, 415/131; 55/1, 52, 199, 203; 417/68

[56] References Cited

U.S. PATENT DOCUMENTS

| | | | |
|---|---|---|---|
| 2,571,802 | 10/1951 | Wilfley et al. | 415/34 |
| 3,413,926 | 12/1968 | Ayson | 415/131 |
| 3,711,218 | 1/1973 | Kennel et al. | 415/131 |
| 3,881,841 | 5/1975 | Straniti | 415/131 |
| 4,422,832 | 12/1983 | Haavik | 416/68 |
| 4,439,096 | 3/1984 | Rockwood et al. | 415/131 |
| 4,776,758 | 10/1988 | Gullichsen | 415/169.1 |
| 4,877,368 | 10/1989 | Timperi et al. | 415/143 |

FOREIGN PATENT DOCUMENTS

| | | | |
|---|---|---|---|
| 2049832A | 12/1980 | United Kingdom | 415/131 |

*Primary Examiner*—Edward K. Look
*Assistant Examiner*—Michael S. Lee
*Attorney, Agent, or Firm*—Cohen, Pontani, Lieberman & Pavane

[57] ABSTRACT

A centrifugal pump for pumping fiber suspensions including a centrifugal pump housing (50) defining a centrifugal pump chamber (54) having a suspension inlet and suspension outlet. Located within the pumping chamber is a centrifugal impeller (60). A vacuum pump chamber (76) defined by a front wall (112) facing the impeller and a rear wall (110) and opposite the front wall is located adjacent the centrifugal pumping chamber (54). A vacuum pump rotor (96) is mounted within the vacuum pump chamber at a distance from the front and the rear walls (112, 110). The axial distance between the vacuum pump rotor and the front and rear walls (112, 110) is adjustable to a value of less than 0.30 mm, and preferably less than about 0.20 mm.

17 Claims, 7 Drawing Sheets

CENTRIFUGAL PUMP

FIELD OF THE INVENTION

The present invention relates to a centrifugal pump having a built-in vacuum pump and specifically to a vacuum pump rotor having minimal clearances between said vacuum pump rotor and axially adjacent walls of the vacuum pump chamber.

BACKGROUND AND SUMMARY OF THE INVENTION

Commercial devices which effectively handle suspensions, such as paper pulp, at medium consistency, that is at about 6–15% solids consistency, are known. It is also known that air or, more generally gas, if present in the fiber suspensions causes problems in almost all process stages in the pulp and paper industry. When pulp is pumped, mixed, screened, washed or otherwise handled without excess gas significant savings in equipment, power consumption and the like can be achieved. For instance, one device which has been particularly successful in allowing handling of gas-containing medium consistency fiber suspensions is a fluidizing centrifugal pump which simultaneously pumps and degasses the suspension. Typically, such pumps utilize a separate vacuum pump, piping from the centrifugal pump to the vacuum pump, a separate motor and motor mount for the vacuum pump, etc., in order to exhaust the gas which has been separated from the suspension so that the suspension may be effectively pumped by the pump impeller.

U.S. Pat. No. 3,230,890 discloses a centrifugal pump for removing gas from low consistency suspensions or from water having either a built-in vacuum pump or an external vacuum pump.

A fluidizing centrifugal pump having a built-in vacuum pump is disclosed in U.S. Pat. No. 4,776,758. FIG. 1 illustrates the prior art centrifugal pump, with the volute being omitted, provided with a vacuum pump on the same shaft as impeller in accordance with U.S. Pat. No. 4,776,758. The characteristic features of the prior art pumps on the market today and which have not, however, proven to be successful due to some shortcoming in the structure thereof, are disclosed in detail in the following. The pump has a fluidizing impeller 12 rotating in an ordinary medium consistency pump housing. The impeller 12 has through bores 14 for allowing the air accumulated at the front side of the impeller 12 to be drawn by means of the vacuum pump 10 to the back side of the impeller 12. The impeller has also so-called back vanes 16 on the back side thereof for separating the fiber suspension from the medium being drawn through the openings 14 in the impeller plate 18. The main purpose of the back vanes 16 is to pump the fiber suspension back to the pump volute and thus prevent the fibers from entering the vacuum pump 10, as the risk of damaging the vacuum pump 10 rises dramatically if the fibers are allowed to enter the vacuum pump 10. The vacuum pump 10 is a so-called liquid ring pump which has been arranged on the pump shaft 20 behind an intermediate plate 22 in which only a narrow ring-shaped duct 24 is provided which duct surrounds the shaft 20 or the impeller extension 26 for allowing the gas to flow towards the vacuum pump. The intermediate plate 22 is also provided with a ring-shaped channel 28 and a narrow duct 30 leading thereto for introducing make-up air to the vacuum pump while the pump is running. The duct 30 is connected via channel 32 to a vacuum regulating valve (not shown). The vacuum pump housing 34 is provided with a conduit 36 for feeding liquid to the liquid ring pump 10 for maintaining the amount of liquid substantially constant therein. Conduit 36 is connected to the outer, eccentric circumference 38 of the liquid ring pump 10. In other words, the conduit 36 leads exclusively and directly to the liquid ring. The suction opening for the liquid ring pump 10 is provided, naturally, on the side of the centrifugal impeller 12. The discharge channel (not shown) for the gas to be removed from the pump 10 is arranged at the opposite side of the vacuum pump 10, i.e. on the back side of the vacuum pump relative to the centrifugal impeller 12.

Various problems have, however, been encountered with the pump in operation today. For example, the air removal capacity has been significantly lower than required, i.e. the vacuum created has not reached a sufficiently high level. Also, the discharge pressure of the vacuum pump has been found to be too low. In some cases, the material discharged from the vacuum pump, a mixture containing mainly gas but also some fibers, has been introduced into the top portion of a mass tower to recover the fibers. If, however, the discharge pressure of the vacuum pump is too low the pumped material cannot be conveyed to the top of the mass tower, and an additional pump must be installed for that purpose. Also, the open annular volume in the intermediate plate 22 of prior art pump has a tendency to become clogged by the fibers.

In the prior art pump the axial gap 40 between the vanes 42 of the vacuum pump 10 and the axially adjacent walls 44 of the vacuum pump housing are not adjustable but are positioned at a distance or clearance of about 0.4 mm. The reasons for such relatively large clearance is the fact that there are a number of factors which render it is impossible to further decrease the clearance 40 as the various components of the pump are installed on the shaft or around the shaft starting from the drive end 46 of the shaft. Thus, the dimensions of the components effect the clearance 40. The result of too wide a clearance is, of course, excess leakage and an insufficient vacuum. Another reason for the wide clearance 40 may also be the fact that the shaft 20 of the pump tends to flex somewhat during operation creating the risk of mechanical contact between the vacuum pump vanes and the housing walls 44. Thus, the large clearance 40 has been provided intentionally to ensure long lasting operation of the pump.

The pump in accordance with the present invention is designed to eliminate most or all of the above problems. Accordingly, the pump of the present invention provides means for adjusting the axial position of the vacuum pump rotor relative to the front and rear wall of the vacuum pump chamber thereby providing significantly smaller operational clearances or distances therebetween. This may be achieved by either adjusting the axial position of the rotor with respect to the shaft, for example, by the addition of shims between respective shoulders of the vacuum pump rotor and shaft. The relative axial position of the vacuum pump rotor with respect to the vacuum pump chamber may also be optimized by adjusting the axial position of the shaft with respect to the vacuum pump chamber and the centrifugal pump body, in which case the vacuum pump rotor is fixedly attached to the shaft. Finally, the relative axial position of the vacuum pump rotor and the vacuum pump chamber is optimized by adjusting the vacuum pump chamber with respect to the rotor and the centrifugal pump body, for example, by adjustment screws as is further described in detail below.

In addition, ports for the admission of make-up air for the control of the vacuum pump may be provided at the rear wall of the vacuum pump and means are provided to introduce a liquid into the pump for flushing the vacuum pump and conduits leading thereto and maintaining the same free from fibers which otherwise tend to block the flow path of the pump.

Axial clearances between the vacuum pump rotor and the vacuum pump chamber walls may also be adjusted by providing a rotor with rotor blades which are slightly inwardly tapered in radial direction or wherein the side walls of the vacuum chamber are slightly outwardly tapered in radial direction relative to the shaft to account for the slight bending or flexing of the shaft during operation of the vacuum pump.

The vacuum pump may also be designed so that the gas inlet port and the gas outlet port are on the same site of the pump in the intermediate wall and wherein the vacuum pump rotor central portion is conically tapered toward the gas outlet of the pump so as to prevent the formation of a gas pocket around the rotor central portion.

The centrifugal pump impeller may also be provided with a rotor having fluidizing blades either within the pump inlet or entirely outside the pump inlet or any combination thereof.

DETAILED DESCRIPTION OF THE PRESENTLY PREFERRED EMBODIMENTS

Figure 1:
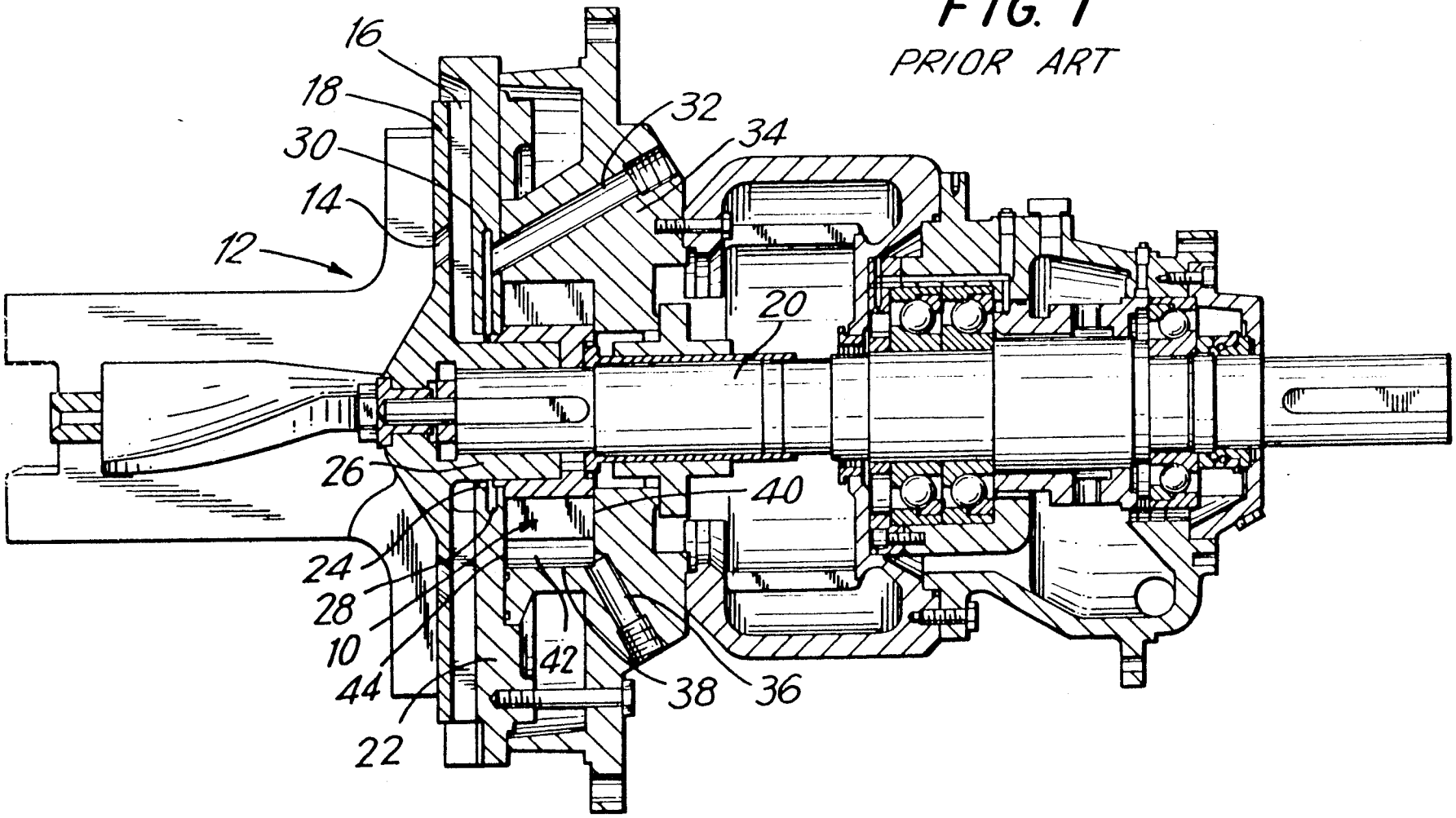
FIG. 1 PRIOR ART
FIG. 1 is a vertical cross-sectional view of an exemplary prior art pump with the conventional pump housing not shown.
Figure 2:
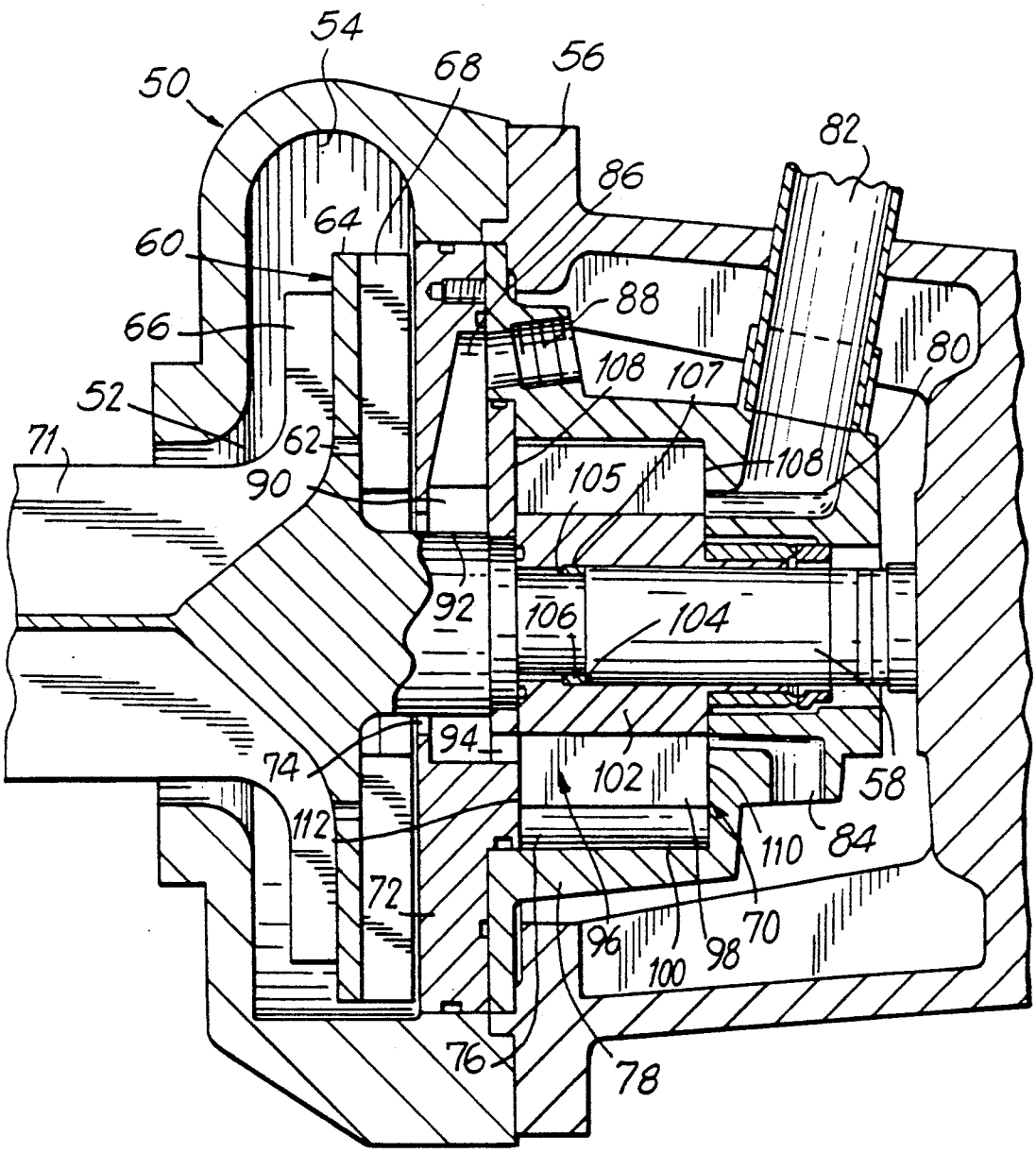
FIG. 2 is a partial vertical cross-sectional view of a centrifugal pump in accordance with the present invention.

FIGS. 2–7 show vertical cross-sectional views of the centrifugal pump in accordance with the present invention. In FIG. 2, the centrifugal pump has a housing 50 including an inlet channel 52 and a volute 54. The housing 50 is attached to the pump frame 56 having at one end thereof the bearing assembly (not shown) for supporting the pump shaft 58 at the end of which the centrifugal impeller 60 having openings 62 through its back plate 64 is mounted. The centrifugal impeller 60 is further provided with front vanes, i.e. working vanes 66, on the front side thereof and with back vanes 68 on the opposite side of the back plate 64. A rotor having fluidizing blades 71 may be mounted on the shaft 58 in front of impeller 60 in case fiber suspensions of medium or high consistency are pumped. The fluidizing blades may extend through the pump inlet 52 or be located only outside the inlet and within the pulp containing vessel. Located between the bearing unit and the centrifugal impeller 60 is the sealing assembly (not shown). Between the sealing assembly and the centrifugal impeller 60 there is mounted a vacuum pump 70 on the same shaft 58 as the centrifugal impeller 60. The vacuum pump 70 is separated from the volute 54, i.e. from the space housing the centrifugal impeller 60, by means of an intermediate plate 72 which also forms the head or the front wall 112 of the vacuum pump 70. In this embodiment plate 72 has a central annular opening 74 for the shaft 58 and for permitting the gas to flow from the space behind the centrifugal impeller 60 to the vacuum pump 70. The vacuum pump chamber 76 is arranged within a vacuum pump housing 78. The vacuum pump 70 is a so-called liquid ring pump with an eccentric chamber 76 relative to the rotor 96. The vacuum pump housing 78 has, in addition to the eccentric chamber 76, a discharge port or pipe 80 for the gas at the pressure side of the chamber 76 (the upper side in FIG. 2) and leading to a gas discharge connection 82 on the outer surface of said housing. The housing 78 further has an additional air duct 84 leading to the eccentric chamber 76 at its suction side (the lower side in the drawing) and through the back wall 110 of the vacuum pump chamber located opposite its front wall 112 or opposite the head or intermediate plate 72. Duct 84 is for providing control or make-up air to the vacuum pump 70, i.e. for controlling the vacuum of the pump and for maintaining the vacuum at a constant level. It is to be noted that air duct 84 is dimensioned with respect to its diameter and length so that the vacuum pump 70 will readily receive additional air in case there is insufficient air flowing from the material to be pumped. A control valve (not shown) for regulating the vacuum of the vacuum pump may be directly attached to the end of the make-up air duct 84. The vacuum pump chamber may also be provided with a second air inlet duct (not shown) either in the front or rear wall so as to be able to draw air from the centrifugal pump through inlet 94 and from a second outside source of air for contemporaneous removal of air from said second source as well as from the medium to be pumped.

In accordance with one embodiment of the present invention, intermediate plate 72 is provided with a relatively wide duct 86 for the introduction of a liquid such as flushing water or the like leading from the connection 88 on the vacuum pump housing or body 78 outer surface to a large open volume 90 within the plate 72 and around the shaft 58 of the pump or around the extension sleeve 92 of the impeller 60. As stated, duct 86 is used for introducing a liquid such as water to the vacuum pump 70, for instance for feeding liquid to the liquid ring or for flushing either the vacuum pump 70, the open volume 90 or the inlet channel 94 to the vacuum pump 70 in case there are solids in these locations which must be removed to prevent the clogging thereof.

The vacuum pump 70 has a rotor 96 with outwardly, not necessarily radially, extending vanes 98 for keeping the liquid ring rotating along the eccentric surface 100 of its chamber 76. The rotor 96 has a cylindrical central portion 102 arranged to lie between a shoulder 104 of the shaft 58 and the centrifugal impeller hub or extension sleeve 92 so that the axial location of the vacuum pump rotor 96 with respect to the centrifugal impeller 60 is fixed. Between the shoulder 104 of the shaft and the shoulder 105 of rotor 96 is a free space 107 into which spacer means may be introduced, for example, by arranging one or more preferably annular shims 106 of predetermined axial width circumjacent the shaft 58 to minimize the axial clearance 108 between the rotor vanes 98 and the side walls 110 and 112 of the vacuum pump chamber.

Accordingly, the provision of shims 106 between the shoulder 104 of shaft 58 and the shoulder 105 of the vacuum pump rotor 96 allows the possibility of precisely adjusting the clearance or distance 108 after manufacture of the components of the pump and during the assembly thereof. This way, all of the above discussed factors which may affect the axial play and location of the centrifugal impeller 60 and the vacuum pump rotor 96 are eliminated. It is thus possible to minimize the clearance or distance 108 between the vanes 98 and the pump chamber walls 110, 112. Preferably, the clearance 108 is as small as about 0.20 mm and in any case less than 0.30 mm.

As stated, the shoulder 105 on the vacuum pump rotor 96 and the shoulder 104 on the shaft 58 are designed so that there is a gap or clearance 107 left therebetween. Upon assembly, the actual desired clearance between the shoulders 104 and 105 is determined and one or more shims with corresponding axial dimension are chosen so that the clearance on both sides of the rotor with respect to the vacuum pump side walls correspond to the predetermined value. Thus, the possibility of adjusting the clearance upon assembly of the pump eliminates the need of over-dimensioning the pump in order to provide safety clearances. The pump shaft has been mounted in axially fixed position with respect to the pump body. If the location of the shaft is altered, for example, due to the replacement of the bearings, the shims 106 can be changed and replaced with shims having smaller or wider axial width so that the position of the vacuum pump rotor is again optimized.

As pointed out above, the vacuum pump rotor 96 can be adjusted so that the clearances 108 between the vacuum pump vanes 98 and side walls 110, 112 of the vacuum pump chamber 76 is as small as about 0.20 mm and, in any case, less than 0.30 mm, preferably less than about 0.25 mm. The rotor is thereafter inserted into the pump chamber 76 as described above by choosing the width of shims 108 in accordance with the desired clearance.

Figure 3:
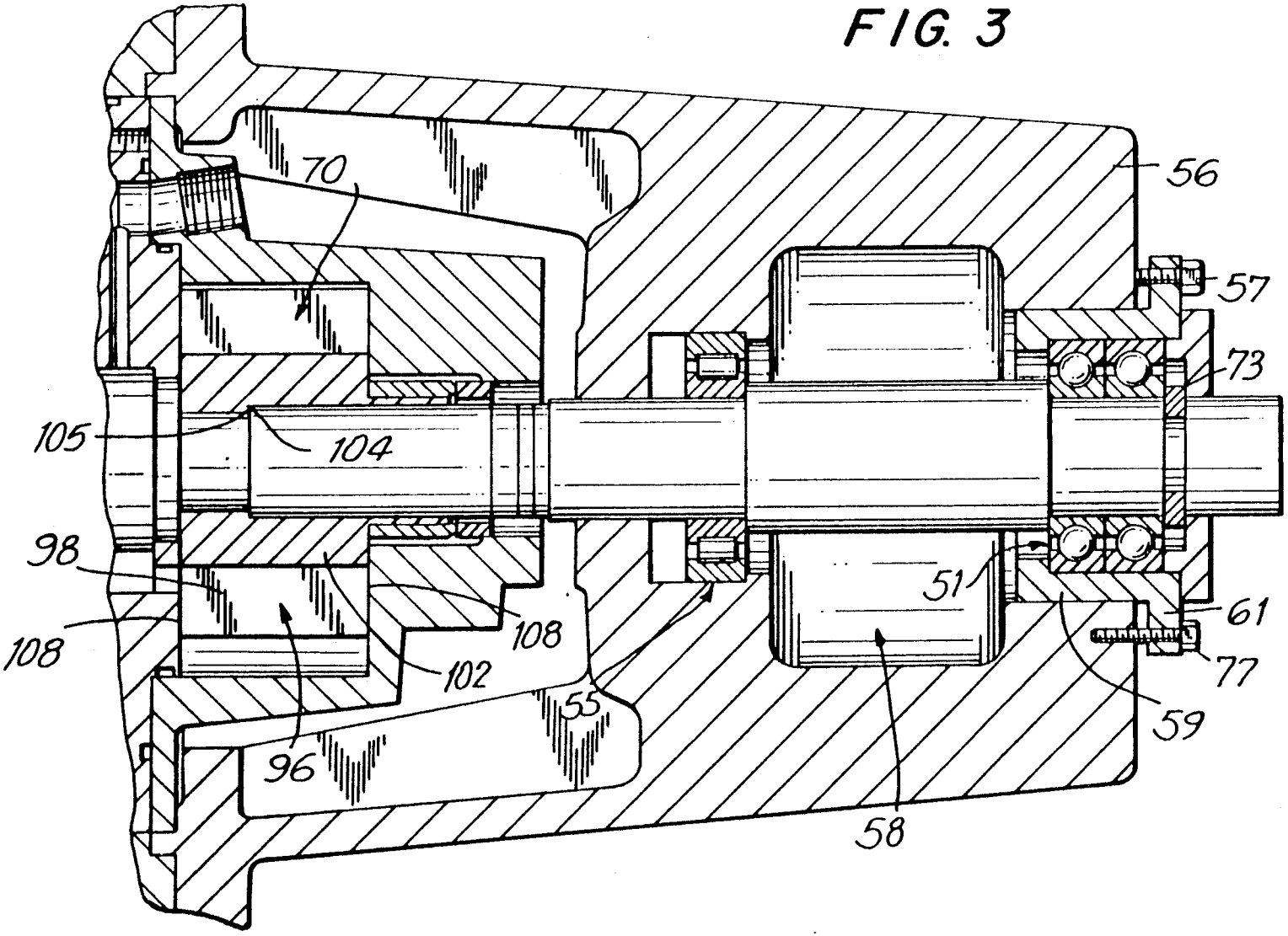
FIG. 3 is a partial cross-sectional view of the vacuum pump chamber and centrifugal pump casing of the present invention with the rotor being fixedly mounted on an axially adjustable shaft.

As shown in FIG. 3, shaft 58 is mounted within pump frame 56 by suitable bearing units 51 and 55. Bearing unit 55 is slidably mounted and the bearing unit 51 is secured with a suitable locking means such as a lock nut 73 so that it will not slide along the shaft. The remainder of the pump is essentially the same as that described in connection with FIG. 2, above. However, in this embodiment, vacuum pump rotor 96 with its center portion 102 and pump vanes 98 is fixedly secured to shaft 58 with the shoulder 105 of rotor 96 engaging a correspondingly shaped shoulder 104 of shaft 58. Instead of adjusting clearances 108 with shims 106 as in FIG. 2 above, in this embodiment, the axial position of the shaft can be adjusted by bolts 57 as follows. Bearing unit 51 is secured to slidable bearing support member 59 by, for example, a tong and groove arrangement (not shown) or any other suitable manner. Support member 59 has a bracket 61 which is provided with a threaded opening for receiving one or more adjusting bolts 57. Turning of bolts 57 will cause the shaft to move in a backward direction away from frame 56. Shaft 58 is kept in fixed position within bearing unit 51 by lock means 73. Adjusting and sliding bolt 77 extends through an opening in bracket 61 and into threaded engagement with frame 56. Turning of adjusting bolts 57 and 77 permits the axial adjustment of shaft 58 in both directions and thus the precise positioning of the vacuum pump rotor 96 within vacuum pump chamber 76 allowing minimal clearances 108 between the rotor and the vacuum pump side walls.

Figure 4:
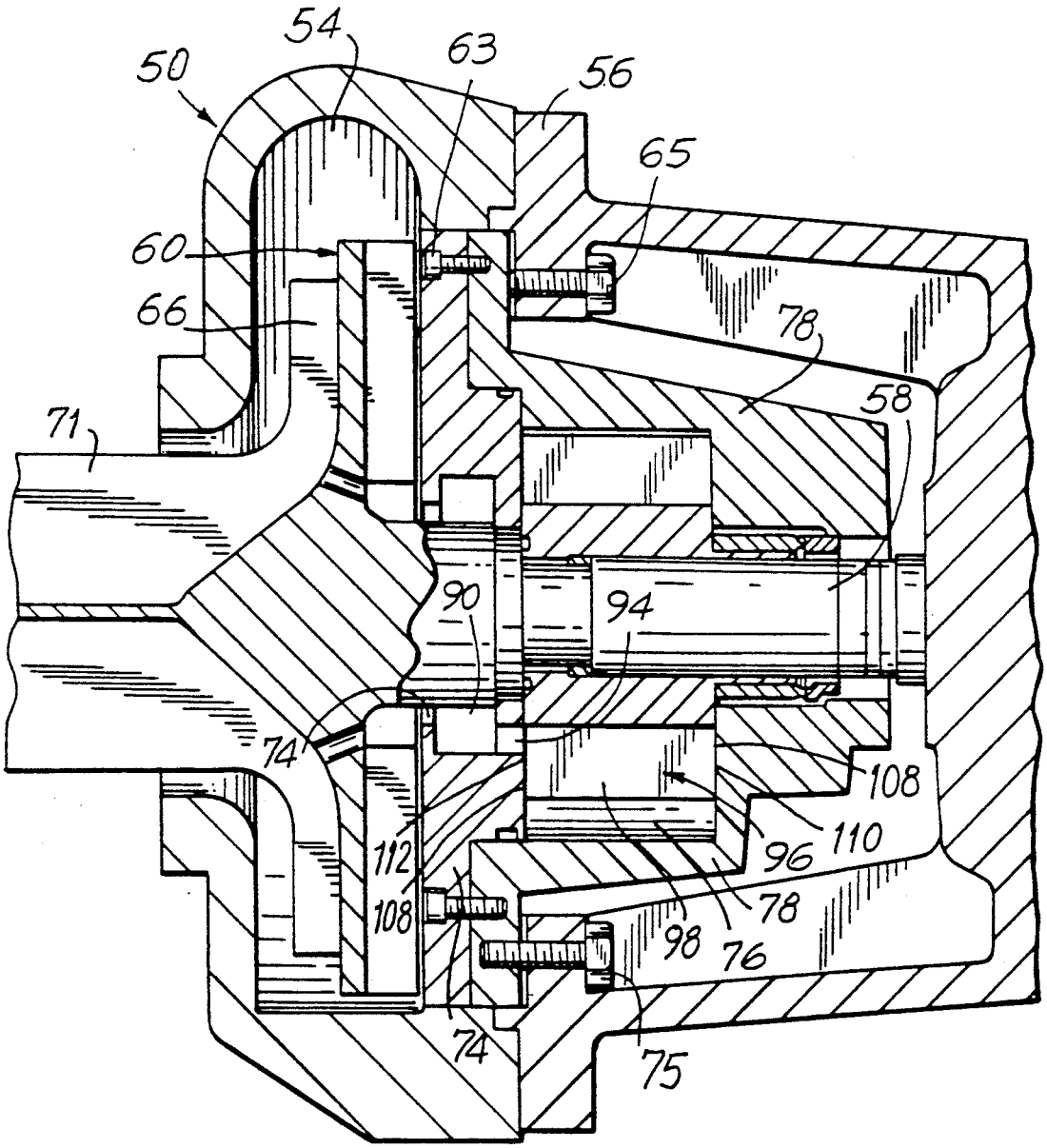
FIG. 4 is a partial cross-sectional view of the pump in accordance with the present invention wherein the body and head of the vacuum pump are fixed and axially adjustable by adjusting screws.

FIG. 4 shows a partial cross-sectional view of the centrifugal pump housing 50 and intermediate wall 72 separating the centrifugal pump chamber from the vacuum pump chamber 76. The intermediate wall 72 also frequently called "air head" or simply "head" has a central portion with an open volume 90 therein which is in communication with the vacuum pump chamber 76 and volute 54 through suitable openings 74 and 94. The vacuum pump housing 78 is fastened to intermediate wall or head 72 by bolts 63. One or more bolts 65 threadedly engage in pump frame 56 and one or more bolts 75 are threadedly engaged in vacuum pump housing 78. Thus, the vacuum pump housing 78 and the fixedly secured head 72 are retained in place relative to the frame 76 by one or more adjusting bolts 65 and 75 which permit the movement of the vacuum pump housing together with head 72 in axial direction relative to the shaft 58 so that the vacuum pump rotor 96 can be arranged within the vacuum pump chamber with optimal clearances 108 between the vacuum pump rotor 96 and its vanes 98 and the vacuum pump side walls 110 and 112. The rotor 96 is fixed on shaft 58 with mutually engaging shoulders 104, 105 as described above.

Figure 5:
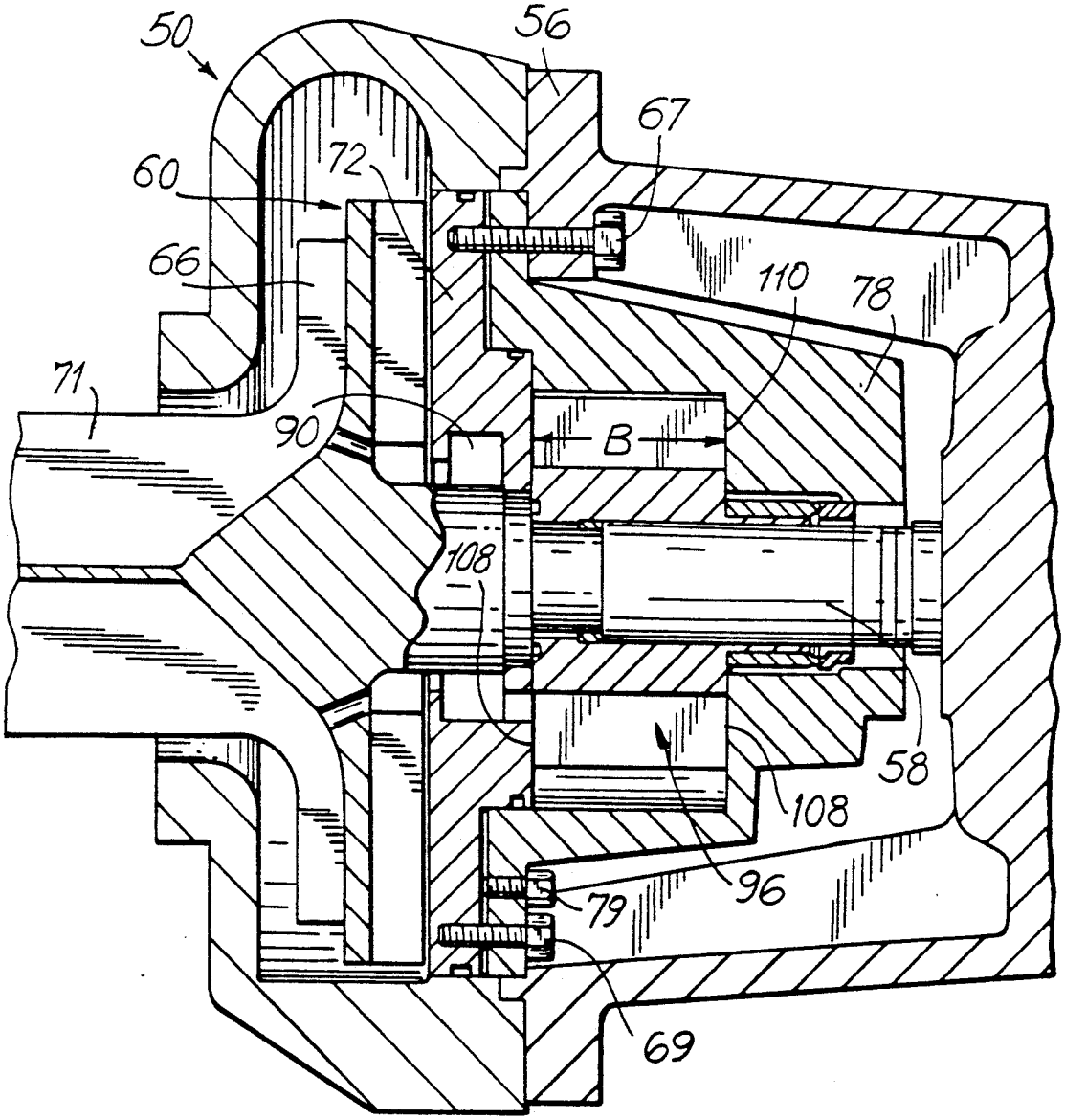
FIG. 5 is a partial cross-sectional view of the vacuum pump chamber of the present invention with adjustable pump body relative to the pump head.

Alternatively, and as shown in FIG. 5, the vacuum pump housing 78 and intermediate plate or head 72 can be adjusted relative to each other so that the width B and thereby the clearance 108 between the vacuum pump rotor and the vacuum pump side walls are optimized. The vacuum pump housing 78 and head 72 are mounted on a protrusion of frame 56 containing an opening for receiving one or more bolts 67 which threadedly engage with head 72. Width B between the vacuum pump housing rear wall 110 and head 72 can be adjusted by turning of one or more adjusting screws 69, 79 whereby screw 69 pulls head 72 toward vacuum pump housing 78, while turning of screw 79 moves the head away therefrom. Frame 56 is secured to pump housing 50 in known manner.

Figure 6:
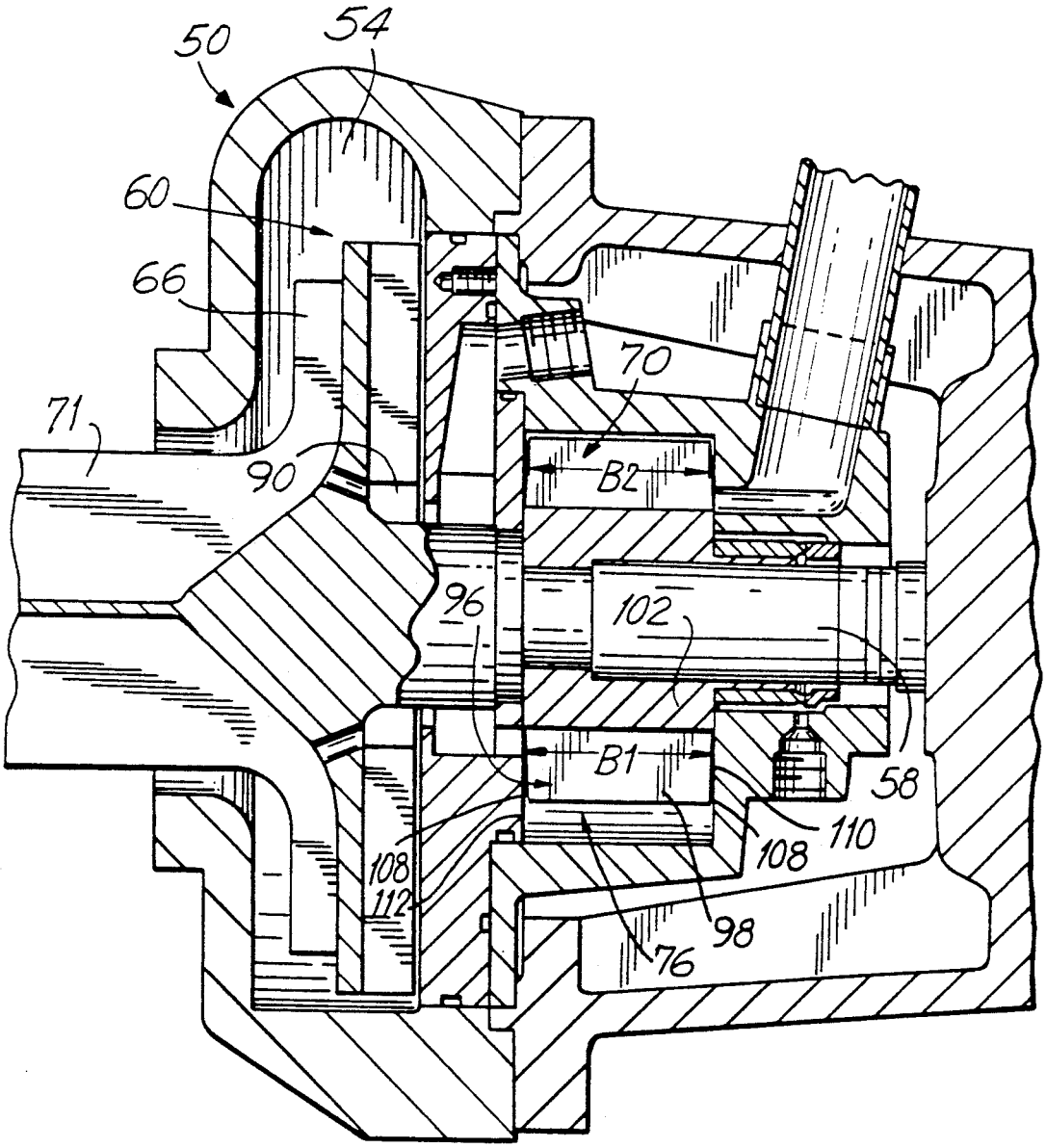
FIG. 6 is a partial vertical cross-sectional view illustrating another embodiment of the present invention.

FIG. 6 shows a vacuum pump rotor 96 which is arranged on pump shaft 58 at a distance from the bearing unit (not shown). In this case, the shaft 58 tends to bend slightly during operation of the pump and, consequently, the clearance 108 between the vacuum pump rotor vanes 98 and the end walls 110, 112 of the vacuum chamber 76 will change so that there is a real risk of mechanical contact between the vanes 98 and the end walls 110, 112 causing extensive wear or even serious damage to the vacuum pump 70 in relatively short time. As shown in FIG. 6, the axial length of one or more of the vanes 98 at the respective tips of the vanes is shorter than the axial length thereof at or close to the central portion 102 of the vacuum pump rotor 96. In other words, the clearance 108 decreases in the direction from the tips of the vanes 98 toward the shaft 58. This decrease in width of the vacuum pump rotor blades can be linear, stepped, curved or any combination thereof. It is also understood that not all of the rotor blades need be tapered in the described fashion.

The vacuum pump chamber walls may also be tapered in a way similar to that described in connection with the rotor blades; or both, rotor blades and vacuum pump chamber wall may be tapered. It is also understood that it is not essential that every rotor blade be tapered in the described manner. For example, only every second vane or blade facing the vacuum pump chamber side walls may be tapered so that the distance between surfaces of rotation of the rotor vane side edges decreases from the rotor central portion toward the tips of the vanes.

Figure 7:
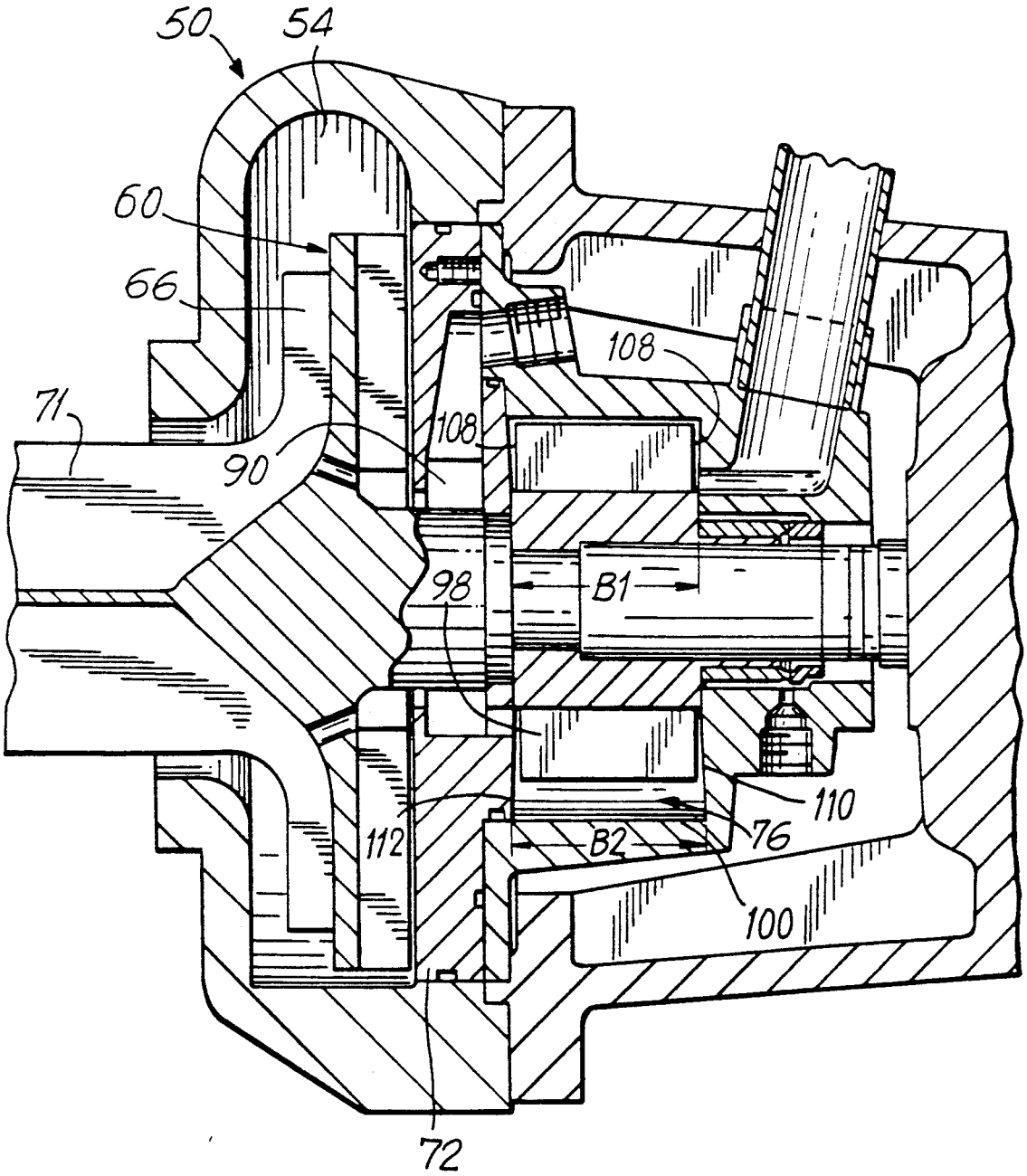
FIG. 7 is a vertical cross-sectional view of yet another embodiment of the present invention.

FIG. 7 shows yet another embodiment and solution to the shaft bending problem. In this embodiment, vacuum pump vanes 98 have equal axial length however, the axial dimension of the eccentric vacuum pump chamber 138 increases towards the outer circumference or surface 100 of the chamber 76 so that the amount of clearance 108 increases in radial direction in the same way as in the embodiment shown in FIG. 6. Accordingly, the axial distance B1 of the vacuum pump chamber 76 is smaller in the area surrounding the shaft than the distance B2 between the vacuum pump chamber side walls at the eccentric surface 100. Again, the vacuum pump chamber side walls may taper radially outwardly in linear fashion, stepwise, curved or any combination thereof. It is also understood that both the two vanes and the vacuum pump chamber wall may taper in radially outwardly direction in the same or similar manner.

Since these as well as further embodiments and modifications thereto are intended to be within the scope of the present invention, the above description should be construed as illustrative and not in a limiting sense, the scope of the invention being defined solely by the appended claims.

What is claimed is:

1. A centrifugal pump comprising:

a centrifugal pump housing (50) defining a centrifugal pumping chamber (54) having an inlet (52) and an outlet;

a centrifugal impeller (60) within said pumping chamber;

a vacuum pump chamber (76) defined by a front wall (112) facing said impeller and a rear wall (110) in spaced relation and opposite said front wall, said chamber having a gas inlet and a gas outlet;

a rotor (96) within said vacuum pump chamber and spaced by a distance from said front and rear walls (112, 110);

an intermediate wall (72) separating said vacuum pump chamber (76) from said centrifugal pump chamber (54);

a rotary shaft (58) extending through said vacuum pump chamber (76) and said intermediate wall (72) into said centrifugal pumping chamber (54);

said centrifugal pump impeller (60) and said vacuum pump rotor (96) being mounted on said shaft; and means operatively connected to one of said walls (112, 110) for moving at least one of said front and rear wall (112, 110) for axially adjusting said distance between said vacuum pump rotor (96) and at least one of said front and rear wall (112, 110).

2. The centrifugal pump of claim 1, wherein said vacuum pump chamber (76) has a pressure side and a suction side and additionally comprising a gas discharge opening (80) at said pressure side of said chamber (76) and a make-up air inlet duct (84) extending into said chamber (76) through said rear wall opposite said intermediate wall (72).

3. The pump as claimed in claim 1, wherein the distance between said vacuum pump rotor (96) and said respective front and rear walls (112, 110) of said vacuum pump (70) is less than 0.30 mm.

4. The pump as claimed in claim 1, wherein said distance between said vacuum pump rotor (96) and said respective front and rear walls (112, 110) of said vacuum pump (70) is about 0.20 mm.

5. The pump as claimed in claim 1, additionally comprising a pump frame (56) mounted to said pump housing (50) and wherein said adjustment means for the axial adjustment of the position of said rotor (96) comprises means for simultaneously moving said vacuum pump chamber (76) and said intermediate wall (72) relative to said vacuum pump rotor (96) for axially adjusting the position of said rotor relative to said front and rear wall (112, 110) of said vacuum pump (70).

6. The pump as claimed in claim 5, additionally comprising a vacuum pump housing (18) including said rear wall (110) and wherein said intermediate wall and said vacuum pump housing (78) are secured to each other and wherein said adjustment means engages said vacuum pump housing (78) and said pump frame (56) for opposed reciprocal movement toward and away from each other for adjusting the position of said rotor (96) relative to that front and rear wall (112, 110).

7. The pump as claimed in claim 5, wherein said means for reciprocally moving said vacuum pump chamber (76) and intermediate wall (72) relative to said pump frame (56) comprises a bolt (75) extending through said frame (56) and secured in threading engagement with said vacuum pump housing (78).

8. The centrifugal pump as claimed in claim 1, wherein said vacuum pump (70) additionally comprises a vane (98) on said rotor (96); a front wall and a rear wall (112, 110) and wherein said vanes (98) of said vacuum pump rotor (96) comprise a radially inner portion and a radially outer portion and lateral edges spaced by a distance and facing said front and said rear wall; and wherein said distance between said edges is greater at said radially inner portion of said vane than at said radially outer portion thereof.

9. The centrifugal pump as claimed in claim 1, wherein said vacuum pump comprises spaced front and rear walls (112, 110), said walls having a radially inner portion and a radially outer portion; and wherein the distance between said walls is greater at said radially outer portion than at said radially inner portion.

10. The pump as claimed in claim 1, additionally comprising a fluidizing impeller in front of said centrifugal impeller.

11. The pump as claimed in claim 10 wherein said fluidizing impeller is located outside said pump inlet.

12. The pump as claimed in claim 1, additionally comprising an open volume (86) within said intermediate plate (72); an opening (94) permitting communication between said volume (86) and said vacuum pump chamber (76); and means for introducing a liquid into one of said open volume (86) and said opening (94) for removing said fiber suspension therefrom.

13. The pump as claimed in claim 12, additionally comprising a duct (88) within said vacuum pump housing (78) and communicating with said open volume (86) for permitting introduction of said liquid thereto.

14. The pump as claimed in claim 1, additionally comprising a pump frame (56) mounted to said pump housing (50) and wherein said adjustment means for the axial adjustment of the position of said rotor (96) relative to the vacuum pump chamber comprises means attached to said pump frame (56) for adjusting the relative position of said intermediate wall (72) to said rear wall.

15. The pump as claimed in claim 14, wherein said adjustment means comprises a first plurality of bolts extending through an equal plurality of non-threaded throughholes within said vacuum pump housing (78) into threaded bores located within said intermediate wall (72) and in alignment with said non-threaded holes; and a second plurality of bolts extending through threaded holes within vacuum pump frame (78) into non-threaded bores located in said intermediate wall (72) and in alignment with said threaded holes.

16. A centrifugal pump comprising:

a centrifugal pump housing (50) defining a centrifugal pumping chamber (54) having an inlet (52) and an outlet;

a centrifugal impeller (60) within said pumping chamber;

a vacuum pump chamber (76) defined by a front wall (112) facing said impeller and a rear wall (110) in spaced relation and opposite said front wall, said chamber having a gas inlet;

a rotor (96) within said vacuum pump chamber and spaced by a distance from said front and rear walls (112, 110);

an intermediate wall (72) separating said vacuum pump chamber (76) from said centrifugal pump chamber (54);

a rotary shaft (58) extending through said vacuum pump chamber (76) and said intermediate wall (72) into said centrifugal pumping chamber (54);

said centrifugal pump impeller (60) and said vacuum pump rotor (96) being mounted on said shaft; and means for axially adjusting said distance between said vacuum pump rotor (96) and at least one of said front and rear wall (112, 110);

said vacuum pump chamber (76) having a pressure side and a suction side and additionally comprising a gas discharge opening (80) at said pressure side of said chamber (76) and a make-up air inlet duct (84) extending into said chamber (76) through said rear wall opposite said intermediate wall (72).

17. A centrifugal pump comprising:

a centrifugal pump housing (50) defining a centrifugal pumping chamber (54) having an inlet (52) and an outlet;

a centrifugal impeller (60) within said pumping chamber;

a vacuum pump chamber (76) defined by a front wall (112) facing said impeller and a rear wall (110) in spaced relation and opposite said front wall, said chamber having a gas inlet and a gas outlet;

a rotor (96) within said vacuum pump chamber and spaced by a distance from said front and rear walls (112, 110);

an intermediate wall (72) separating said vacuum pump chamber (76) from said centrifugal pump chamber (54);

a rotary shaft (58) extending through said vacuum pump chamber (76) and said intermediate wall (72) into said centrifugal pumping chamber (54);

said centrifugal pump impeller (60) and said vacuum pump rotor (96) being mounted on said shaft;

means for moving at least one of said front and rear wall (112, 110); and a pump frame (56) attached to said housing (50); said vacuum pump rotor (96) being fixedly mounted to said shaft (58) within said vacuum pump chamber (76); and said adjustment means for the axial adjustment comprising a shaft bearing unit (51) disposed circumjacent said shaft and slidably mounted on said frame (56); said shaft being mounted within said frame (56) and said bearing unit (51) so that upon sliding movement of said bearing unit the position of said rotor is axially adjusted relative to said front and rear walls (112, 110) of said vacuum pump (70) by movement of said shaft (58);

said adjustment means additionally comprising a support member (59) fixedly secured to said bearing unit (51); lock means (73) for fixedly mounting said shaft to said bearing unit (51); said support member (59) having a plurality of threaded holes therein and said frame (56) having a plurality of non-threaded holes therein in alignment with said threaded holes in said support member; a plurality of bolts (57) extending through said threaded holes into said non-threaded holes so that upon movement of said bolts said support member together with said shaft will move in a first direction; said support member further having a plurality of non-threaded holes therein and said pump frame (56) having a plurality of threaded holes therein in alignment with said non-threaded holes in said support member; a plurality of second bolts (77) extending through said non-threaded holes of said support member into said threaded holes of said frame so that, upon rotation of said bolts, said support member and said shaft will move in a second direction.

* * * * *